US005979505A

United States Patent [19]

Drechsel

[11] Patent Number: 5,979,505

[45] Date of Patent: Nov. 9, 1999

[54] SEWER VENT DEICER

[76] Inventor: Lowell Drechsel, RR. 1, Box 131, Erhard, Minn. 56534

[21] Appl. No.: 09/020,371

[22] Filed: Feb. 9, 1998

[51] Int. Cl.[6] ..... F16L 53/00

[52] U.S. Cl. ..... 138/32; 138/96 R

[58] Field of Search ..... 138/32, 27, 96 R

[56] References Cited

U.S. PATENT DOCUMENTS

| | | | |
|---|---|---|---|
| 365,258 | 6/1887 | Hurt | 138/27 |
| 1,011,669 | 12/1911 | Temme | 138/27 |
| 2,079,269 | 5/1937 | Williams | 138/32 |
| 2,618,293 | 11/1952 | Moran | 138/32 |
| 4,398,453 | 8/1983 | Wilkerson . | |
| 4,399,743 | 8/1983 | Izzi, Sr. . | |
| 4,442,643 | 4/1984 | Stadheim . | |
| 5,129,387 | 7/1992 | Behrens . | |
| 5,245,804 | 9/1993 | Schiedegger et al. . | |
| 5,431,815 | 7/1995 | Te-Shin | 138/96 R |
| 5,595,030 | 1/1997 | Pulscher . | |
| 5,694,724 | 12/1997 | Santiago . | |

*Primary Examiner*—James F. Hook
*Attorney, Agent, or Firm*—Michael S. Neustel

[57] ABSTRACT

A sewer vent deicer for reducing the accumulation of ice within the exhaust portion of the sewer vent pipe during cold weather by increasing the flow of warm sewer gases through the sewer vent pipe. The inventive device includes a cap defining a cavity, a plurality of side apertures within the cap, an upper aperture within the cap, a tube attached to the lower portion of the cap, and an insulating sleeve removably positioned within the tube. The sewer vent pipe is surrounded by the insulating sleeve positioned within the tube thereby maintaining the temperature within the sewer vent. A stream of air enters a side aperture into the cavity which then horizontally passes over the open sewer vent pipe and thereafter exits an opposing side aperture. The air stream passing through the cavity reduces the pressure above the sewer vent pipe thereby causing the warm sewer gases within the sewer vent pipe to rise into the air stream. This increased flow of warm sewer gases maintains a desirable temperature within the lumen of the sewer vent which is not conducive to freezing.

14 Claims, 3 Drawing Sheets

SEWER VENT DEICER

BACKGROUND OF THE INVENTION

1. Field of the Invention

The present invention relates generally to sewer vents and more specifically it relates to a sewer vent deicer for reducing the accumulation of ice within the exhaust portion of the sewer vent pipe during cold weather by increasing the flow of warm sewer gases through the sewer vent pipe. Sewer vent pipes are a source of moist air which are especially susceptible to freeze up when cold temperatures are incurred.

The likelihood of freeze up is increased when precipitation either from sleet or snow comes into engagement with the warmer sewer vent pipe. As the temperature drops, the accumulated precipitation within the lumen and about the exterior portion of the sewer vent tube freezes solid thereby blocking air flow through the lumen of the sewer vent pipe which allows deadly sewer gases to backup into the sewage system of the building. Hence there is a need for an economical and efficient means for preventing the freezing of sewer vent pipes.

2. Description of the Prior Art

There are numerous sewer vent deicing devices. The prior art devices utilize either insulation or electricity to reduce ice accumulation within the sewer vent pipes. For example, U.S. Pat. No. 4,398,453 to Wilkerson; U.S. Pat. No. 5,595,030 to Pulscher; U.S. Pat. No. 4,399,743 to Izzi, Sr.; U.S. Pat. No. 4,442,643 to Stadheim; U.S. Pat. No. 5,245,804 to Schiedegger et al; U.S. Pat. No. 5,129,387 to Behrens; U.S. Pat. No. 5,694,724 to Santiago all are illustrative of such prior art.

Pulscher U.S. Pat. No. (5,595,030) discloses a vent pipe frost build-up inhibitor which is mounted to a sewer vent pipe. The apparatus comprises a frame containing a central rotatable shaft with a wind turbine and four vanes on the end within the vent pipe. The rotation of the shaft causes the four vanes to scrape off frost build-up. The lack of rotation is an indication that there is excessive build-up of frost. Pulscher does not reduce the amount of frost build-up after a small amount of frost has accumulated within the lumen of the sewer vent pipe as disclosed in the present invention.

Stadheim U.S. Pat. No. (4,442,643) discloses an insulating sleeve for placement about the exposed portion of the sewer vent pipe for retaining a warm temperature within the sewer vent pipe. The insulating sleeve comprises a tubular shaped member constructed of insulating material which is covered by a protective outer shell. Stadheim does not disclose a means for increasing the flow of warm air through the sewer vent pipe as disclosed in the present invention.

While these devices may be suitable for the particular purpose to which they address, they are not as suitable for reducing the accumulation of ice within the exhaust portion of the sewer vent pipe during cold weather by increasing the flow of warm sewer gases through the sewer vent pipe. None of the prior art devices provide a means for increasing the flow of the warm sewer gases within the sewer vent pipe for preventing the accumulation of ice within the sewer vent pipe.

In these respects, the sewer vent deicer according to the present invention substantially departs from the conventional concepts and designs of the prior art, and in so doing provides an apparatus primarily developed for the purpose of reducing the accumulation of ice within the exhaust portion of the sewer vent pipe during cold weather by increasing the flow of warm sewer gases through the sewer vent pipe.

SUMMARY OF THE INVENTION

A primary object of the present invention is to provide a sewer vent deicer that will overcome the shortcomings of the prior art devices.

Another object is to provide a sewer vent deicer that does not require electricity or other power source for preventing ice build-up within the sewer vent pipe.

An additional object is to provide a sewer vent deicer that increases the flow of warm sewer gases within the sewer vent pipe.

A further object is to provide a sewer vent deicer which is of a simple construction and has no moving components.

Another object is to provide a sewer vent deicer that is aesthetically pleasing and is not conspicuous when positioned on a sewer vent pipe.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
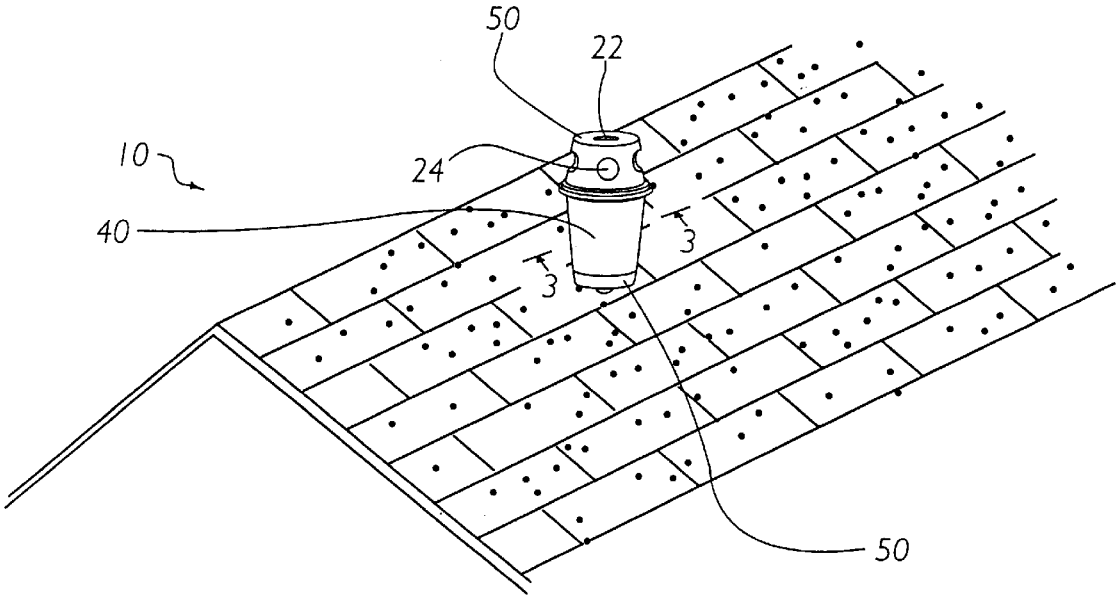
FIG. 1 is an upper perspective view of the present invention positioned about a sewer vent pipe.
Figure 2:
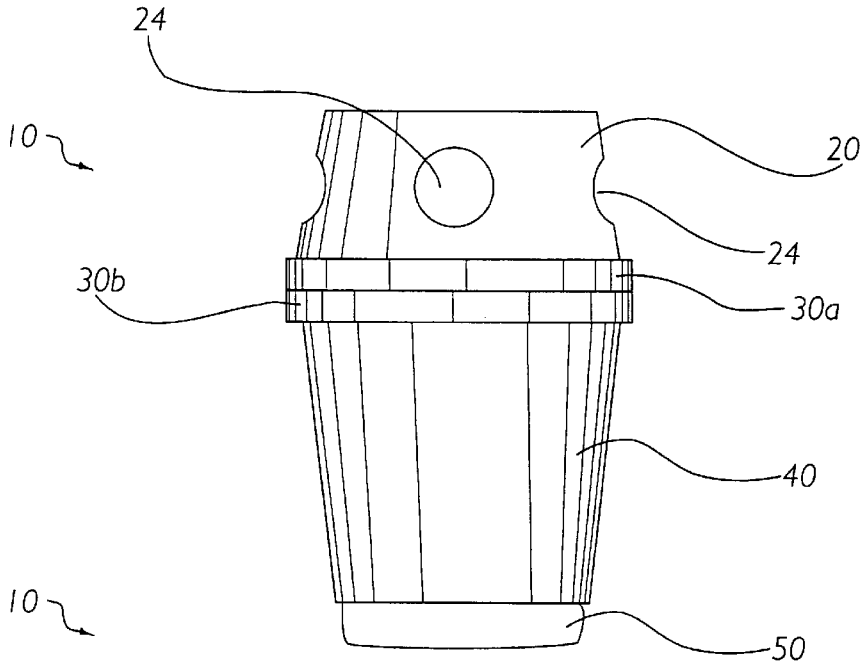
FIG. 2 is a side view of the present invention disclosing the side apertures and insulating sleeve.

Turning now descriptively to the drawings, in which similar reference characters denote similar elements throughout the several view, FIGS. 1 through 4 illustrate a sewer vent deicer 10, which comprises a cap 20 defining an unnumbered cavity, a plurality of side apertures 24 within the cap 20, an upper aperture 22 within the cap 20, a tube 40 attached to the lower portion of the cap 20, and an insulating sleeve 50 removably positioned within the tube 40. The sewer vent pipe 12 is surrounded by the insulating sleeve 50 positioned within the tube 40 thereby maintaining the temperature within the sewer vent pipe 12. A stream of air enters a side aperture 24 into the unnumbered cavity which then horizontally passes over the open sewer vent pipe 12 and thereafter exits an opposing side aperture 24. The air stream passing through the cavity reduces the pressure above the sewer vent pipe 12 thereby causing the warm sewer gases within the sewer vent pipe 12 to rise into the air stream. This increased flow of warm sewer gases maintains a desirable temperature within the lumen of the sewer vent pipe 12 which is not conducive to freezing.

Figure 3:
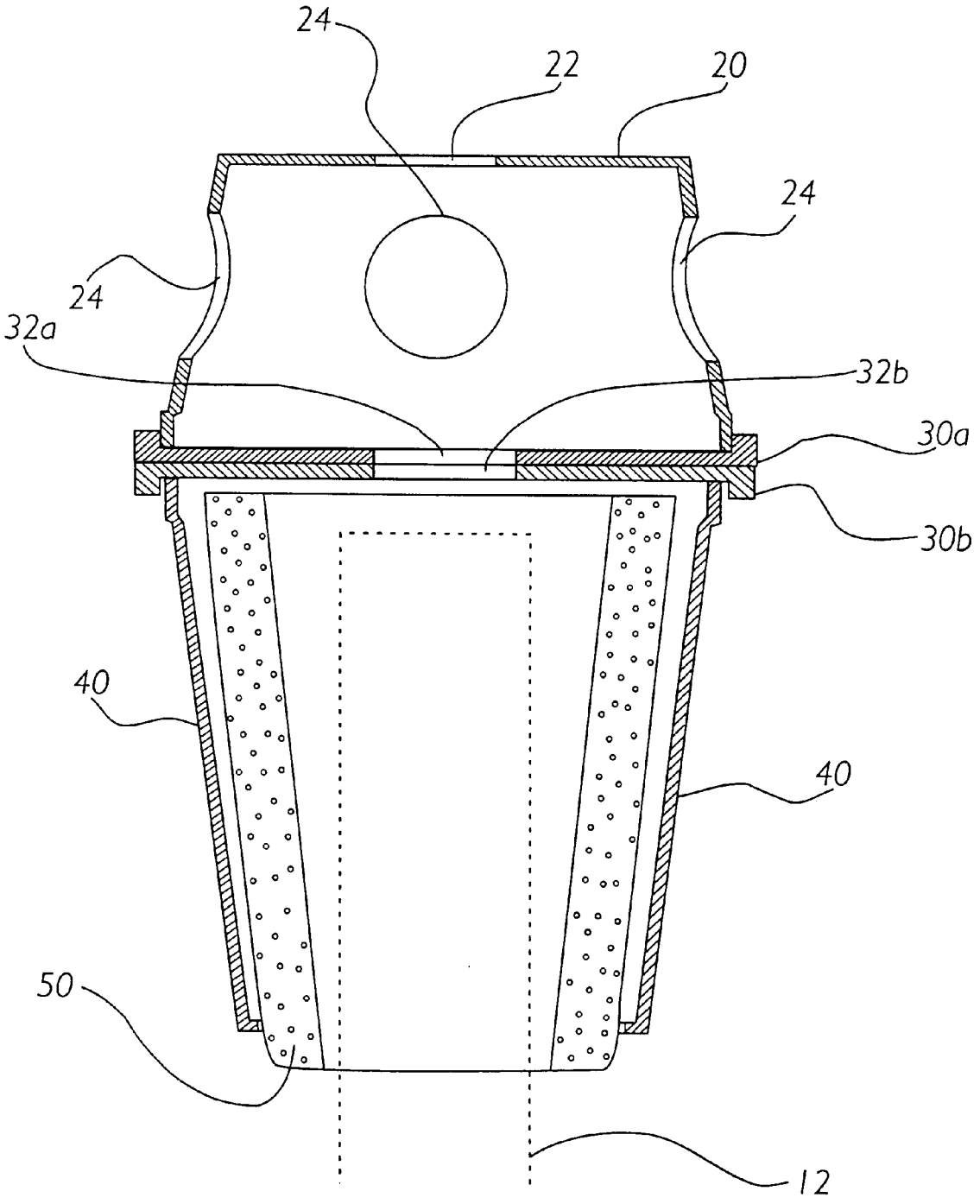
FIG. 3 is a cross section view taken along line 3—3 of FIG. 1.
Figure 4:
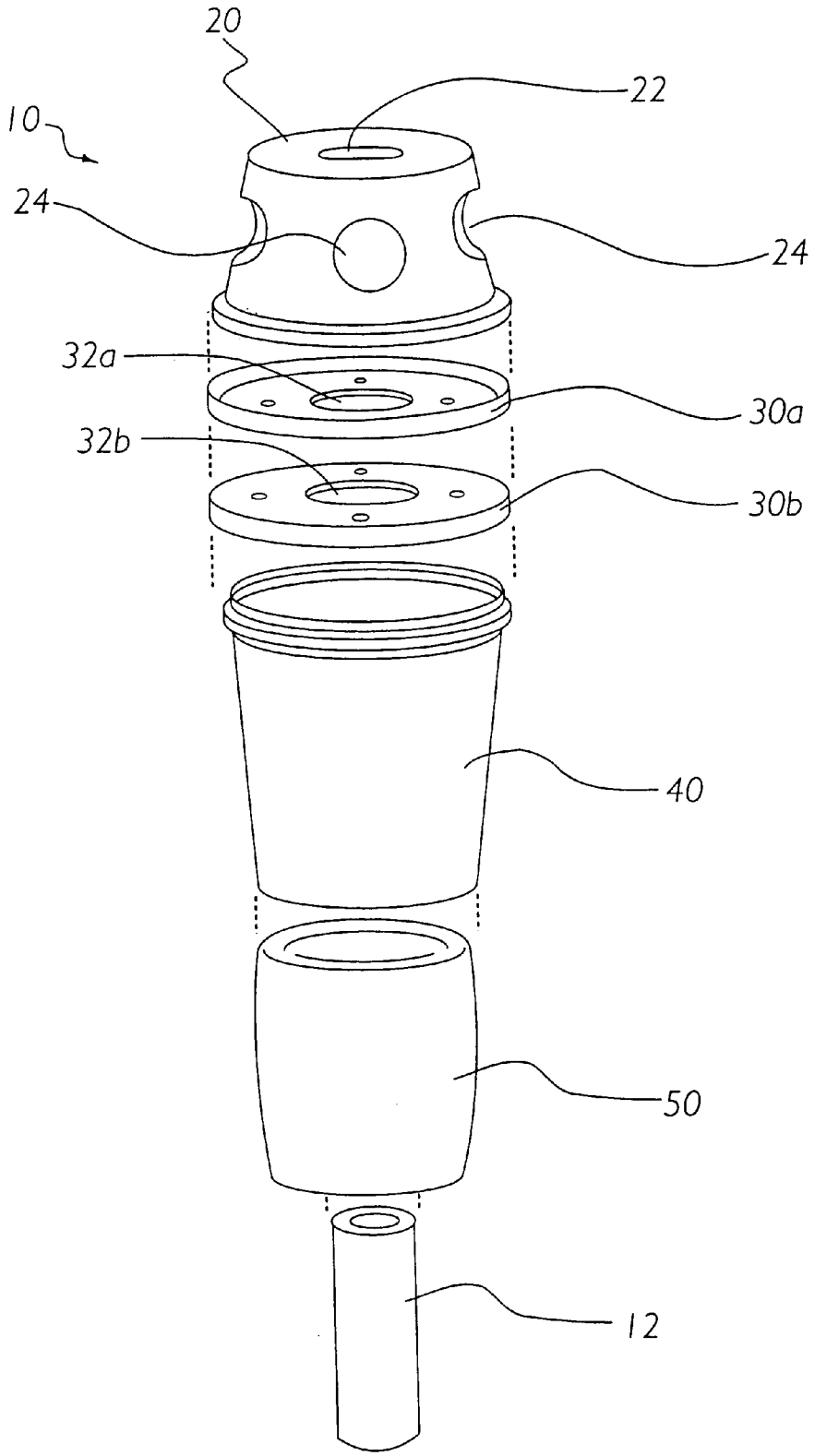
FIG. 4 is an exploded upper perspective view of the present invention.

As best shown in FIGS. 1 and 4, the cap 20 is cylindrical shaped with a flat cornice and an open end opposite of the flat cornice. The cap 20 contains the unnumbered cavity as best shown in FIG. 3 of the drawings. As best shown in FIGS. 1 and 4 of the drawings, the cap 20 includes a plurality of side apertures 24 for receiving a stream of air produced by the wind. Preferably, there are four side apertures 24 with each of the four side apertures 24 in opposition to another side aperture 24. The side apertures 24 may be formed into any shape including circles, squares, and other various shapes. At least one upper aperture 22 is within the cornice of the cap 20 as best shown in FIGS. 1, 3 and 4 of the drawings.

As best shown in FIG. 3 of the drawings, the tube 40 tapers downwardly from the upper portion. The insulating sleeve 50 is removably positioned within the tube 40 as best shown in FIG. 3. The insulating sleeve 50 is comprised of an insulating material. The insulating sleeve 50 removably surrounds the sewer vent pipe 12 as shown in FIGS. 3 and 4 of the drawings. The insulating sleeve 50 helps maintain a temperature within the sewer vent pipe 12 which is not conducive to freezing.

As best shown in FIG. 3 of the drawings, an upper joiner ring 30*a* is in engagement with the open end of the cap 20. A lower joiner ring 30*b* is in engagement with the upper end of the tube 40 as shown in FIG. 3 of the drawings. The joiner rings 30*a–b* are removably attached by a plurality of unnumbered fasteners. The upper joiner ring 30*a* includes a center aperture 32*a* and the lower joiner ring 30*b* includes a corresponding center aperture 32*b* for allowing the flow of sewer gas from the sewer vent pipe 12 into the cavity of the cap 20 as shown in FIG. 3 of the drawings.

In use, the insulating sleeve 50 is positioned about the exterior portion of the sewer vent pipe 12 as shown in FIG. 3 of the drawings. The tube 40 of the present invention is slipped over the positioned insulating sleeve 50, as shown in FIG. 3, so as to align the lumen of the tube 40 with the center apertures 32*a–b*. During cold weather, the sewer vent pipe 12 alone is susceptible to freezing thereby preventing the escape of sewer gases from a sewage system within a building. When there is air flow outside of the building, an air stream enters a side aperture 24 within the cap 20. The air stream then flows into the cavity of the cap 20 directly above the sewer vent pipe 12 and exits an opposing side aperture 24. The air stream flow above the sewer vent pipe 12 reduces the pressure above the sewer vent pipe 12 which draws the warm sewer gases within the sewer vent pipe 12 into the cavity of the cap 20. The sewer gases then join the air stream or exit another side aperture 24 or exit the upper aperture 22. This increased flow of sewer gas maintains a temperature within the cap 20 and the sewer vent pipe 12 which is not conducive to freezing. The flow of sewer gas is maintain even if the buildup of ice should occur within the cap 20 or the sewer vent pipe 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sewer vent deicer, comprising:

a cap having a longitudinal axis, a cornice and a cavity, wherein a portion of said cavity receives a portion of a sewer vent pipe;

said cap includes at least two side apertures for receiving an exterior air stream; and an insulating sleeve removably positionable within a lower portion of said cap, wherein said insulating sleeve surrounds said sewer vent pipe for maintaining a desirable temperature within said sewer vent pipe.

2. The sewer vent deicer of claim 1, wherein said at least two side apertures are substantially in opposition to one another.

3. The sewer vent deicer of claim 2, wherein said cornice of said cap includes at least one upper aperture.

4. The sewer vent deicer of claim 3, wherein said cap includes four side apertures.

5. The sewer vent deicer of claim 4, wherein said four side apertures comprises a first pair of side apertures and a second pair of side apertures, wherein said first pair of side apertures are in opposition to one another and wherein said second first pair of side apertures are in opposition to one another.

6. The sewer vent deicer of claim 5, wherein said cap is cylindrical shaped.

7. A sewer vent deicer, comprising:

a cap having a longitudinal axis, a cornice and a cavity;

said cap includes at least two side apertures for receiving an exterior air stream;

an insulating sleeve removably positionable within a lower portion of said cap, wherein said insulating sleeve surrounds said sewer vent pipe for maintaining a desirable temperature within said sewer vent pipe; and a tube attached to said open end of said cap, wherein said tube is removably attachable to a sewer vent pipe.

8. The sewer vent deicer of claim 7, including:

a first joiner ring having a first center aperture;

a second joiner ring having a second center aperture, wherein said second center aperture corresponds to said first center aperture;

wherein said first joiner ring is attached to said open end of said cap; and wherein said second joiner ring is attached to an upper end of said tube.

9. The sewer vent deicer of claim 8, wherein said at least two side apertures are substantially in opposition to one another.

10. The sewer vent deicer of claim 9, wherein said cornice of said cap includes at least one upper aperture.

11. The sewer vent deicer of claim 10, wherein said cap includes four side apertures.

12. The sewer vent deicer of claim 11, wherein said four side apertures comprises a first pair of side apertures and a second pair of side apertures, wherein said first pair of side apertures are in opposition to one another and wherein said second first pair of side apertures are in opposition to one another.

13. The sewer vent deicer of claim 12, wherein said cap is cylindrical shaped.

14. A sewer vent deicer, comprising:

a cap having a longitudinal axis, a cornice and a cavity positionable about a sewer vent pipe;

said cap includes a first pair of apertures in opposition to one another configured for receiving an exterior air stream that enters said cap passing over an upper edge of said sewer vent pipe thereby drawing warm air from within said sewer vent pipe; and said cap includes a second pair apertures in opposition to one another and offset from said first pair of apertures by approximately 90 degrees configured for receiving an exterior air stream that enter said cap passing over an upper edge of said sewer vent pipe thereby drawing warm air from within said sewer vent pipe.

* * * * *